United States Patent [19]

Allen

[11] 4,257,578

[45] Mar. 24, 1981

[54] OIL WELL SERVICE RIG

[76] Inventor: Walter H. Allen, P.O. Box 3344, Parkersburg, W. Va. 26101

[21] Appl. No.: 923,658

[22] Filed: Jul. 11, 1978

[51] Int. Cl.[3] ..... B66D 1/08; B66D 1/26

[52] U.S. Cl. ..... 254/298; 254/310; 254/315; 254/335

[58] Field of Search ..... 254/150 FH, 183, 184, 254/185 R, 185 B, 187.6, 187.7, 187.8, 187.1, 187.5, 187.4, 298, 294–297, 303, 310, 315, 321, 322, 335, 345, 361, 367, 375; 242/156, 99; 212/162, 230, 239, 262, 264

[56] References Cited

U.S. PATENT DOCUMENTS

| | | | |
|---|---|---|---|
| 3,035,414 | 5/1962 | Smith | 254/150 FH |
| 3,722,707 | 3/1973 | Hedeen | 254/185 R X |
| 3,776,518 | 12/1973 | Witwer | 254/150 FH |
| 3,797,325 | 3/1974 | Christison | 254/187.6 X |
| 3,988,008 | 10/1976 | Morrow et al. | 254/150 FH |
| 4,069,088 | 1/1978 | Cottam | 242/156 X |
| 4,185,520 | 1/1980 | Henneman et al. | 254/187.6 X |

*Primary Examiner*—John M. Jillions

*Attorney, Agent, or Firm*—Mason, Mason and Albright

[57] ABSTRACT

An oil well service rig having three reels, two of the reels actuated by a hydraulic pump through a gear box which provides for selective engagement or disengagement and a two speed gear ratio change for either reel, the hydraulic pump being driven by a gasoline engine. An independent hydraulically operated brake system is utilized on the reels wherein one side of each reel is provided with a greater diameter than the other side, the larger side having a brake caliper pad assembly in engagement therewith. A smaller reel, also controlled by the hydraulic motor, controls the inclination and disposition of a mast having a double sheave assembly at its top receiving cables from each main reel for raising and lowering tools into the oil well shaft.

12 Claims, 5 Drawing Figures

OIL WELL SERVICE RIG

BACKGROUND OF THE INVENTION

This invention relates to oil well service rigs for servicing oil and gas wells. Such service rigs are used in oil wells for cleaning, to bail, to remove sand, to swab through tubing, to remove tubing, and for other maintenance and repair jobs.

An oil well, as other mechanical contrivances, requires maintenance and repair from time to time. This is frequently provided by means of an oil well service rig. However, conventional rigs tend to be expensive and require several men to operate same. Because of this, such rigs are not always readily available and the resulting down time can mean days and even weeks of lost oil well production. The situation has become particularly acute at the present time because of the oil shortage whereby it has become desirable to rehabilitate a number of oil and gas wells to improve, or to place same in, production as requirements dictate. Thus there is a need which exists and has existed, in fact, for a number of years for an oil well service rig which is reasonably inexpensive to purchase and operate and which can be conveniently operated by the single individual.

Concerning cooperation of hydraulic motor for operating a reel, this is disclosed in U.S. Pat. No. 3,887,163 to C. J. Prange. However the operation of components involved is different from that involved in the instant invention.

With reference to the gear box arrangement as disclosed herein, devices showing gear trains which can be placed in different arrangements for operating multiple output shafts are shown in the patents to Falk et al U.S. Pat. No. 2,943,504, to Varcoe U.S. Pat. No. 2,527,281, to Van der Bleek et al U.S. Pat. No. 504,289 and a German Pat. No. 1,095,700. However such arrangements are directed to different types of gear shifts that are not involved in the instant invention.

With reference to the use of a disc of a central drum for braking purposes, attention is invited to the U.S. patents to Hannay et al, U.S. Pat. No. 2,906,472, to M. Maroshick, U.S. Pat. No. 2,593,045, to D. D. Price, U.S. Pat. No. 3,599,974, to H. J. Mase, U.S. Pat. No. 666,852, to to L. M. de Kanski et al, U.S. Pat. No. 2,605,056, to R. W. Goode, U.S. Pat. No. 2,939,647, and to E. W. Reynolds, U.S. Pat. No. 2,571,061. However none of the above patents discloses the combination of utilizing a hydraulic disc type brake as taught in the instant invention.

SUMMARY OF THE INVENTION

Essentially the present invention involves an oil well service rig which is powered by a hydraulic pump, hydraulic motor combination, the hydraulic pump being driven by a gasoline engine. The hydraulic pump actuates a pair of reels having cable wound thereon through a gear box which provides for the selective engagement or disengagement of either reel and, in addition, provides for two speeds for each reel when engaged. Thus the gear box has a shifting mechanism which incorporates two high and low speeds independently operating one or more reels at the same time. An independent hydraulically operated brake system is utilized on the reels wherein one side of the reels is provided with a greater diameter and larger gauge disc than the other side thus providing a disc which may be engaged directly by a brake caliper pad assembly on each side thereof for slowing or stopping the reel. The rig in accordance with the invention is capable of transmitting a very high torque at low speeds with extreme smoothness and control.

Other adaptabilities and capabilities of the invention will be understood by those skilled in the art and as the description progresses, reference being had to the accompanying drawings in which:

BRIEF DESCRIPTION OF THE PREFERRED EMBODIMENT

Figures 1, 4, 5:
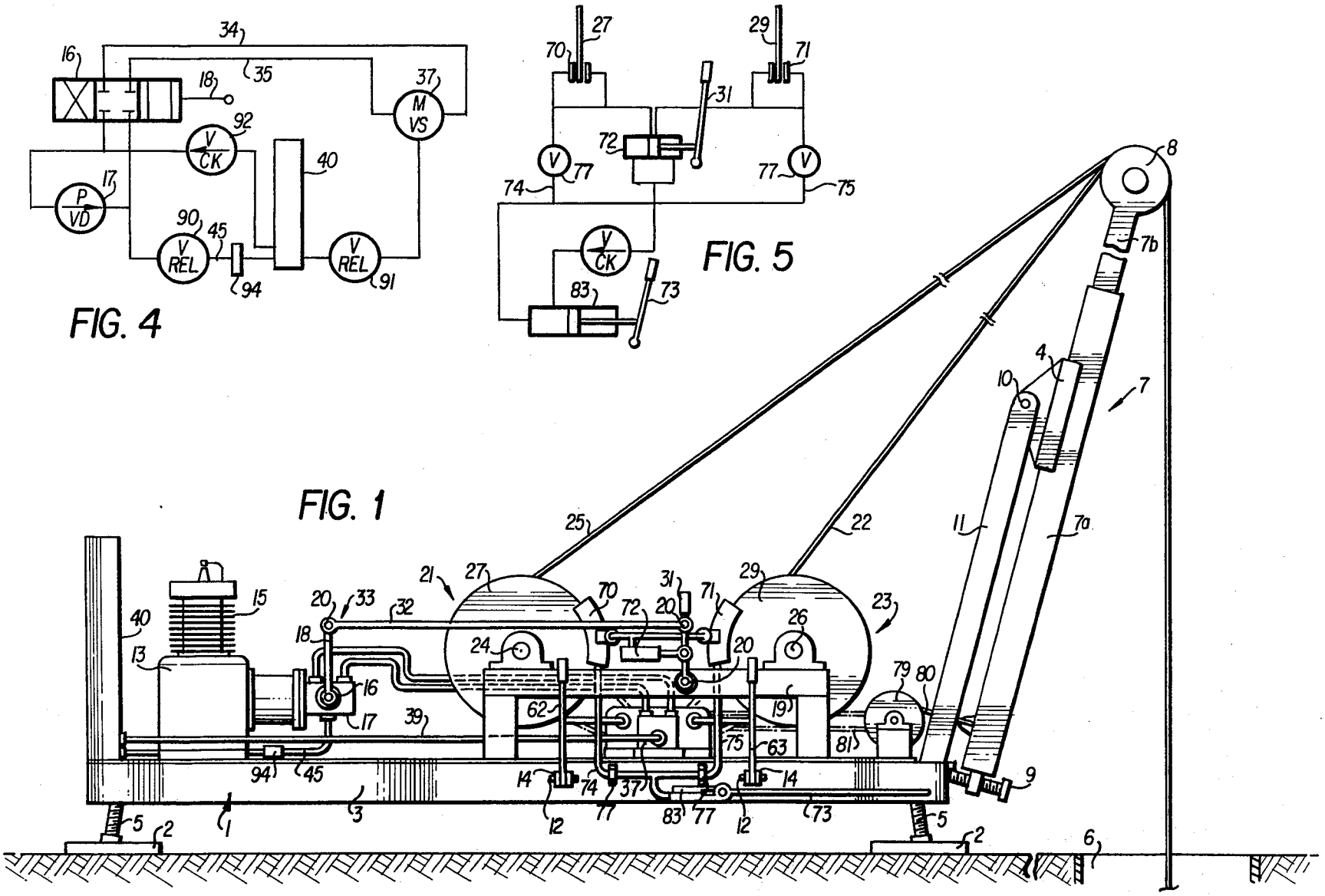
FIG. 1 is a side elevation of the invention.
FIG. 4 is a diagrammic representation of the hydraulic power circuit in accordance with the invention.
FIG. 5 is a diagrammic representation of the hydraulic circuit for the disc brakes of the invention.

In FIG. 1, a service rig designated generally by reference numeral 1 has a platform frame 3 movable over the ground and adjustable end supports 5 including ground (or truck bed) engaging members 2 extending therefrom which enable rig 1 to be supported from the ground, a truck bed or the like, whereby a telescoping boom 7 with a double sheave 8 at its outer end, on the outer portion *7b* of boom 7 which is supported from frame 3, is positioned directly over a well 6. Boom 7 has an adjusting screw 9 and is pivoted to frame support 11 (having the shape of an inverted "V") with pin 10 through a bracket 4 secured to the lower portion *7a* of boom 7 and the lower end of support 11 is preferably affixed to one end of frame 3. Optionally however, it may be hinged to frame 3 whereby it has a limited arcuate movement of about 90° to 110° relative thereto. At the opposite end of frame 3, a power plant 13, preferably comprising a conventional gasoline engine 15, is mounted and the power output drive from engine 15 is directly connected to a reversible hydraulic pump 17.

Figure 2:
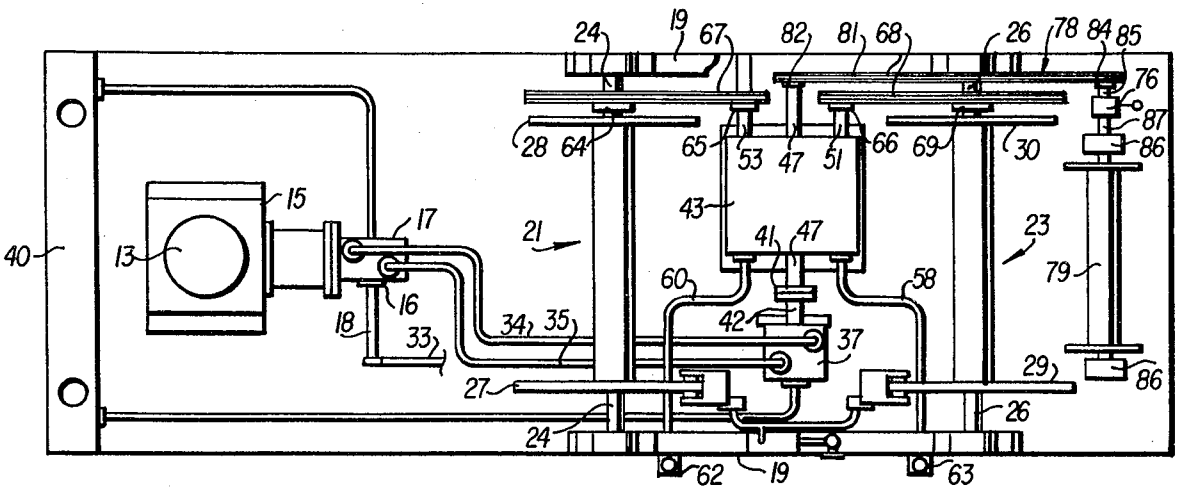
FIG. 2 is a plan view of the invention as shown in FIG. 1.
Figure 3:
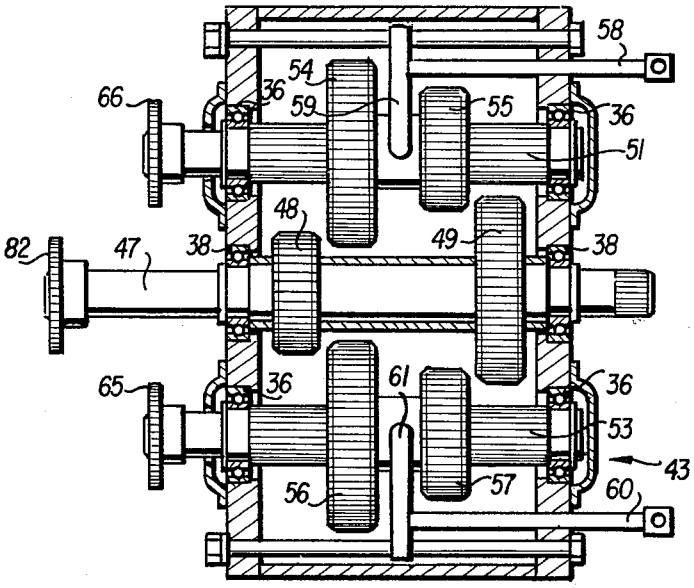
FIG. 3 is a cross-sectional view of the gear box utilized in the invention.

Between boom 7 and engine 15, a pillow and block superstructure 19 mounted at both longitudinal edges of frame 3 supports two drums or reels 21 and 23 having respective axle shafts 24 and 26 on which steel cables 25 and 22 or the like are wound. Each reel has two end discs between which each steel cable is held. In FIG. 2, it can be seen that one such disc 27, for reel 21, and a further disc 29, for reel 23, are each larger than the other opposite discs, 28 and 30, respectively, in both thickness and diameter. Such discs are normally made from steel.

At one side of superstructure 19 a control lever 31 is turnably mounted in a bearing journalled in superstructure 19 to pivot in an arc in either of two opposite directions and linkage 33 from lever 31 is connected to a double acting valve 16 and simultaneously to an over center swashplate controlling the output of a variable displacement, axial piston pump 17 which includes the over center swashplate. Linkage 33 comprises a bar 32 connected through pivot pins 20 to lever 31 and a bar 18 which is rigidly connected to the control shaft for valve 16 and the swashplate of pump 17. Pump 17 supplies hydraulic fluid under pressure in a first hydraulic circuit and lines 34 and 35 to lead to a fixed displacement reversible hydraulic motor 37. Return line 39 and motor 37 lead to an air cooled reservoir 40 mounted on frame 3 adjacent engine 15. Engine 15 is preferably operated at a constant speed whereby hydraulic fluid is circulated to operate motor 37 and output shaft 42, connected to a coupling 41, in either a clockwise or counterclockwise direction. Moving lever 31 to the right or left as seen in FIG. 1 results in turning output shaft 42 in either a clockwise or counterclockwise direction, respectively As may be understood with reference to FIG. 4, a neutral position of the double acting valve 16 and the over center swashplate in pump 17 results in cycling the fluid directly to reservoir 40 through bypass line 45 via a pressure relief valve 90 and strainer 94. Excess pressure in motor 37 is similarly relieved to reservoir 40 through a pressure relief valve 91. Fluid in reservoir 40 is returned to the pump 17 through check valve 92. A strainer 94 is provided in line 45.

Output shaft 42 is connected via coupling 41 to a driving shaft 47 journalled by ball bearing-assemblies 38 in gear box 43 which houses gears 48 and 49, splined rigidly to shaft 47. Driven shafts 51 and 53 are also mounted in gear box 43 by means of further ball bearing assemblies 36 journalled therein. Shafts 51 and 53 are splined for substantially their entire length within gear box 41 and gears 54 and 55 have internal matching splines which enable these gears to be slideable along the length of shaft 51 to mesh with gears 48 and 49 respectively for differential output speeds. In the same manner, gears 56 and 57 are splined to shaft 53 for movement along the length of that shaft within gear box 41 and selective mesh with either gear 48 and 49 respectively. Gears 54 and 55 are integral or connected together to maintain their relative spacing whereby both gears move together and cannot be engaged simultaneously. The same is true of gears 56 and 57. The teeth of the gears are all straight whereby they are parallel to the axes of shafts 51 and 53, and are bevelled at their edges, so that the intermeshing of gears is easily effected. This is accomplished by pivoting yoke 59 to slide gears 54 and 55 and/or yoke 61 to displace gears 56 and 57. Yokes 59 and 61 are connected to cranks 58 and 60 respectively which are actuated by corresponding handle levers 62 and 63, the lower ends of which are pivoted to frame 3 by means of brackets 14 affixed to frame 3 through pins 12 which are received through aligned openings in brackets 14 and the lower portions of handle levers 62 and 63.

The shafts 53 and 51 constituted driven output shafts of corresponding chain 67 and 68 and sprocket 65 and 66 drives to sprockets 64 and 69 secured to reel axle shafts 24 and 26 respectively. Thus, either or both reels 21 and 23 can be driven via driving shaft 47 and motor 37 in either direction. Either one of the two aforementioned reels can be geared for higher torque and lower speed than the other so that the corresponding cable 22 or 25 can be used to pull tubing from a well at relatively low speed and the other line can at the same time lower tools at relatively high speed. In either case, lever 31 is manually operated to reverse the direction of line movements and brake the cable movements rapidly without the jerks of conventional clutch and transmission arrangements.

Placing pump valve 16 and the swashplate control in pump 17 in neutral, in effect, affords a hydraulic brake so that neither reel moves. On the other hand, reel speed is increased and torque decreased the farther lever 31 is displaced from a central neutral position. Being able to select the gear combination offers further flexibility in servicing a well.

Associated with control lever 31 is a brake mechanism and a second hydraulic system which is closed and includes a brake caliper assembly 70 and 71 for each reel, 21 and 23, respectively. When additional braking for either reel 21 and/or 23 is needed, control lever 31 should be in neutral or near neutral position as shown in FIG. 1. As may be understood with reference to FIG. 5, a valve 72 is adapted to relieve hydraulic pressure and therefore disengage the brake calipers of assemblies 70 and 71 when moved to the right or left by lever 31 to preclude engagement of the brakes when substantial power is applied to motor 37. Thus valve 72 is in neutral position also as seen in FIG. 1, and lever 73 can be pivoted upwardly to force brake fluid through conduits 74 and 75 actuating the pads of calipers 70 and 71 on both sides of discs 27 and 29 whereby such discs and the reels of which they form a part are caused to become stationary. Valve 72 has its stem connected to control lever 31 whereby it is moved by movement of such lever. Valves 77 in conduits 74 and 75 provide adjustment for the relative brake fluid flow rate through such conduits.

Driving shaft 47 extends beyond gear box 43 to a further chain and sprocket drive assembly 78 which can be placed in engagement through gear box 76 to turn drum 79 winding or paying out cable 80 which raises or lowers boom 7*b* and support 11. The sprocket drive assembly 78 comprises a chain 81 received around sprocket 82 rigidly secured to the end of shaft 47 and a sprocket 84 ridigly secured to shaft 85 of gear box 76. A drum shaft 87 extends from the other side of gear box 76 and is supported by bearings 86 mounted on frame 3.

With the gasoline engine 13 operating, hydraulic pump 17 transmits hydraulic fluid under pressure to hydraulic motor 37 thus transmitting power by rotating shaft 42, coupling 41 and shaft 47 which has keyed thereto gears 48 and 49. By movement of lever 31, the operator controls both the speed and direction of one or both of the reels 21 and 23 and thus cables 25 and 26 depending upon the disposition of the gears in gear box 43. In this connection, it will be appreciated that by manipulation of cranks 58 and 60 through handles 62 and 63 either gear 54 or gear 55 on shaft 51 or gear 56 or gear 57 on shaft 53 can be selectively placed in engagement with gear 48 (for gears 54 and 56) and gear 49 (for gears 55 and 57).

Normally braking is obtained by lever 31 due to the restricted flow of the hydraulic fluid between pump 17 and motor 37. However, if direct braking of the reels 21 and 23 is desired this can be obtained by pulling lever 73 and thus actuating the master brake cylinder 83 whereupon the pads of brake caliper 70 and 71 contact the discs 29 and 27 respectively causing them to stop. This provides an additional measure of control.

A power plant 13 found practicable in practice is a Kohler 23 H.P. gasoline engine. Known disc brake system as used on standard model automobiles operate well. For example, attention is invited to the disc brake assembly disclosed in U.S. Pat. No. 3,938,628. Acceptable hydraulic pumps and motors for pump 17 and motor 37 including controls may be found in Sundstrand's 15 Series, Copyright Sunstrand Corp., 1974. In practice a Sunstrand 15 Series pump with a 4000 Series Char-Lynn motor provides good results. The Sundstrand 15 Series, as described in the copyrighted publication (A-518865) consists of a variable displacement, over center swashplate, axial piston pump. Speed is directly proportional to the control lever's position. Speeds of the Char-Lynn 4000 Series Hydraulic motor of up to about 400 rpm may be obtained with pressures up to 4500 psi. Usual working pressure is 2500 psi. Examples of the type hydraulic motor involved are disclosed in U.S. Pat. Nos. 3,270,683; 3,272,142; 3,307,582 and U.S. Pat. No. 3,572,983. The machine so powered is essentially for wells in the 1000 to 2500 feet depth range although a depth range of up to 4000 feet can be obtained without modification of such power plant including the hydraulic pump and motor.

Although the preferred embodiment of the invention is described herein, it is to be understood that it is capable of other adaptations and modifications within the scope of the appended claims.

Having thus described my invention, what I claim as new and desire to secure by Letters Patent of the United States is:

1. A service rig comprising at least one line reel and driving means engaging said reel to rotate same in either one of two directions, said driving means including a hydraulic, reversible pump and motor system and a power source operating said hydraulic pump at substantially constant speeds, settable control means connected to said hydraulic pump, said hydraulic pump supplying varying amounts of fluid to operate said hydraulic motor with a substantially constant torque at selected speeds and a continuously constant hydraulic pressure responsive to the settings of said control means, said control means being manually operable, a mechanical linkage connected to said control means in said hydraulic pump, said control means being displaceable from a neutral position to either one of two operative positions and directing fluid flow from said hydraulic pump to said hydraulic motor driving said hydraulic motor in either one of two opposite directions, said reel having two end discs for confining said cable wound around said reel, one of said discs being larger than the other said disc, said one disc having a brake caliper assembly that bears on relative opposite sides at substantially the circumference thereof, said caliper assembly being operatively connected through a valve member to a second hydraulic assembly which is completely independent of said hydraulic pump and motor system, said linkage being movable and said valve member being displaceable from a neutral position by said mechanical linkage, said reel being braked by the caliper assembly bearing on both sides of said one disc, and a gear assembly operatively connected to the output of said hydraulic motor, said gear assembly comprising a driven gear that engages and rotates said reel to pay out and retrieve line.

2. The rig of claim 1, wherein there are two line reels and each of said reels has a corresponding brake caliper assembly positioned to bear on both sides of a respective disc thereof.

3. The rig of claim 2, wherein said gear assembly comprises a driving gear on a drive shaft that is directly connected to a rotatable shaft of said motor and at least one corresponding driven gear that engages a respective reel, manual means selectively engaging the driving gear to either one of said driven gears by axially moving the selected driven gear.

4. The rig of claim 3, wherein there are two driven gears on a single driven shaft for each reel and two driving gears on said drive shaft, and said manual means shifting said driven gears into engagement with either of said driving gears during operations of the rig while said gears are rotating.

5. A service rig comprising a mobile frame and at least one line reel journalled on said frame, driving means comprising a variable speed power plant and a hydraulic system connected to rotate said reel in either direction, said system including a variable displacement axial piston pump connected to the power plant and a fixed displacement reversible motor in hydraulic communication with said pump through a two way circuit, single lever means connected to control means in said pump and said control means being settable by said single lever means to direct varying amounts of fluid to said motor in either one of two opposite directions through the circuit, said motor driving at a substantially constant hydraulic pressure with a substantially constant torque gear means and the latter engaging said reel to rotate same when paying out and retrieving line, said gear means comprising first and second driving gears and first and second driven gears and means for selectively engaging said first gears while said second gears are disengaged and engaging said second gears while said first gears are disengaged and disengaging all of said gears at the same time, and brake means for said reel, said brake means including a further hydraulic system actuated by said single lever.

6. The rig of claim 5, wherein there are two line reels and said gear means selectively engages either of said reels to rotate same.

7. The rig of claim 6, wherein said single lever means is a turnable lever that is linked to said control means and the latter has a neutral position in which substantially no fluid circulation takes place through said circuit.

8. The rig of claim 7, wherein said gear means comprises a housing with said driving gears positioned between said two reels, said reels being mounted on corresponding substantially horizontal axle shafts and a respective output shaft with said driven gears and further like driven gears being in driven connection with each of said horizontal shafts via chain and sprocket means, said driven gears being selectively shiftable to neutral, high or low speed engagement with said driving gears.

9. The rig of claim 8, wherein a boom is pivoted to one side of the frame and lines from said reels and passed through a sheave assembly on said boom, a further line reel being rotatably driven by said motor and a line from said further reel being interconnected to said boom to raise and lower same, a separate gear arrangement being provided for said further line reel for selectively engaging same with output shaft of said motor.

10. The rig of claim 7, wherein said brake means for said reels comprises a respective brake caliper assembly adjacent the circumference of a respective disc of that reel, each assembly being operatively connected to said further hydraulic circuit via a displaceable valve, said single lever being turnable to displace that valve and operate said assembly.

11. A reel for an oil well rig in combination with a hydraulic braking system, said reel comprising a pair of spaced apart discs which serve the function of retaining cable wound around the reel, one of said discs having a diameter greater than the other said disc, a pair of fluid operated brake pads disposed relative to the periphery of said one disc whereby one of said pads is on each side of said disc, substantially at said periphery said pads being in an opposed disposition and adapted to exert a squeezing action against the outer sides of said one disc when actuated, and fluid pressure means for actuating said pads.

12. A reel in accordance with claim 11 wherein said fluid pressure means comprises a mechanical interconnection only to means for controlling a motor provided to operate said reel, fluid pressure relieving means connected to said control means whereby fluid under pressure is not supplied to actuate said pads unless said motor is substantially inactivated.

* * * * *